US006616473B2

(12) United States Patent
Kamata et al.

(10) Patent No.: US 6,616,473 B2
(45) Date of Patent: Sep. 9, 2003

(54) THIN-TYPE ELECTRICAL CONNECTOR HAVING A LOCKING FUNCTION

(75) Inventors: Kazushi Kamata, Hirosaki (JP); Hiroaki Obikane, Tachikawa (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/025,020

(22) Filed: Dec. 19, 2001

(65) Prior Publication Data

US 2002/0076968 A1 Jun. 20, 2002

(30) Foreign Application Priority Data

Dec. 19, 2000 (JP) ..... 2000/386022

(51) Int. Cl.[7] ..... H01R 13/627
(52) U.S. Cl. ..... 439/352; 439/607
(58) Field of Search ..... 439/352, 350, 439/351, 353–358, 607–610

(56) References Cited

U.S. PATENT DOCUMENTS 6,116,937 A * 9/2000 Pan ..... 439/352
6,132,231 A * 10/2000 Suzuki ..... 439/352
6,146,180 A * 11/2000 Betker et al. ..... 439/352
6,165,017 A * 12/2000 Kuo ..... 439/357
6,168,453 B1 * 1/2001 Kuo ..... 439/357
6,257,914 B1 * 7/2001 Comerci et al. ..... 439/357
6,457,987 B1 * 10/2002 Yeh ..... 439/352

FOREIGN PATENT DOCUMENTS

JP 10-302893 11/1998

* cited by examiner

*Primary Examiner*—Gary Paumen
(74) *Attorney, Agent, or Firm*—Michael, Best & Friedrich LLC

(57) ABSTRACT

An electrical connector includes first and second connectors fitted to each other in a first direction. The first connector includes a locking member extending in the first direction and displaceable in a second direction, a lever extending from the locking member in a third direction, a protruding portion protruding from the lever in the second direction, and an unlocking arm extending in the first direction and displaceable in the third direction. The second connector has a locking portion to be engaged with an engaging portion of the locking member in the first direction when the first and the second connectors are fitted to each other. Engagement between the engaging portion and the locking portion is released when the protruding portion is pressed by a cam portion of the unlocking arm to displace the locking member in the second direction through the lever.

9 Claims, 7 Drawing Sheets

THIN-TYPE ELECTRICAL CONNECTOR HAVING A LOCKING FUNCTION

BACKGROUND OF THE INVENTION

This invention relates to an electrical connector having a locking function for maintaining a connected state.

A thin-type electronic apparatus such as a notebook-type personal computer may be provided with a liquid crystal display. In order to connect the liquid crystal display, use is made of various types of connectors. Following a demand for further reduction in thickness of the electronic apparatus, the liquid crystal display used therein is also reduced in thickness. This requires the reduction in thickness of the connector for connecting the liquid crystal display. In the connector having a reduced thickness, however, the connection strength may not be sufficiently large. In order to augment or reinforce the connection strength, the connector in a connected state is often fixed by the use of a tape or adhered by the use of an adhesive.

On the other hand, a locking structure for maintaining an ordinary connector in a connected state is disclosed, for example, in Japanese Unexamined Patent Publication No. 10-302893 (JP 10-302893 A). However, the locking structure requires a large displacement and a large operating force in order to operate its operating portion. After all, the use of the locking structure makes it difficult to reduce the thickness of the connector. Thus, it is inappropriate or disadvantageous to use the locking structure in the connector for connecting the liquid crystal display.

SUMMARY OF THE INVENTION

It is therefore an object of this invention to provide an electrical connector which has a locking function but can easily be reduced in thickness.

It is another object of this invention to provide an electrical connector of the type in which an unlocking operation is easy.

Other objects of the present invention will become clear as the description proceeds.

According to an aspect of the present invention, there is provided an electrical connector including a first and a second connector fitted to each other in a first direction. The first connector comprises a locking member extending in the first direction and displaceable in a second direction perpendicular to the first direction, a lever extending from the locking member in a third direction perpendicular to the first and the second directions, a protruding portion protruding from the lever in the second direction, and an unlocking arm extending in the first direction and displaceable in the third direction. The locking member has an engaging portion to be engaged with the second connector in the first direction. The unlocking arm has a cam portion for pressing the protruding portion in the second direction when the unlocking arm is displaced in the third direction. The second connector has a locking portion to be engaged with the engaging portion in the first direction when the first and the second connectors are fitted to each other. Engagement between the engaging portion and the locking portion being released when the protruding portion is pressed by the cam portion to displace the locking member in the second direction through the lever.

According to another aspect of the present invention, there is provided a plug connector which comprises a locking member extending in a first direction and displaceable in a second direction perpendicular to the first direction, a lever extending from the locking member in a third direction perpendicular to the first and the second directions, a protruding portion protruding from the lever in the second direction, and an unlocking arm extending in the first direction and displaceable in the third direction. The locking member has an engaging portion to be engaged with a receptacle connector in the first direction. The unlocking arm has a cam portion for pressing the protruding portion in the second direction when the unlocking arm is displaced in the third direction. Engagement between the engaging portion and the receptacle connector is released when the protruding portion is pressed by the cam portion to displace the locking member in the second direction through the lever.

DESCRIPTION OF A PREFERRED EMBODIMENT

Figure 1:
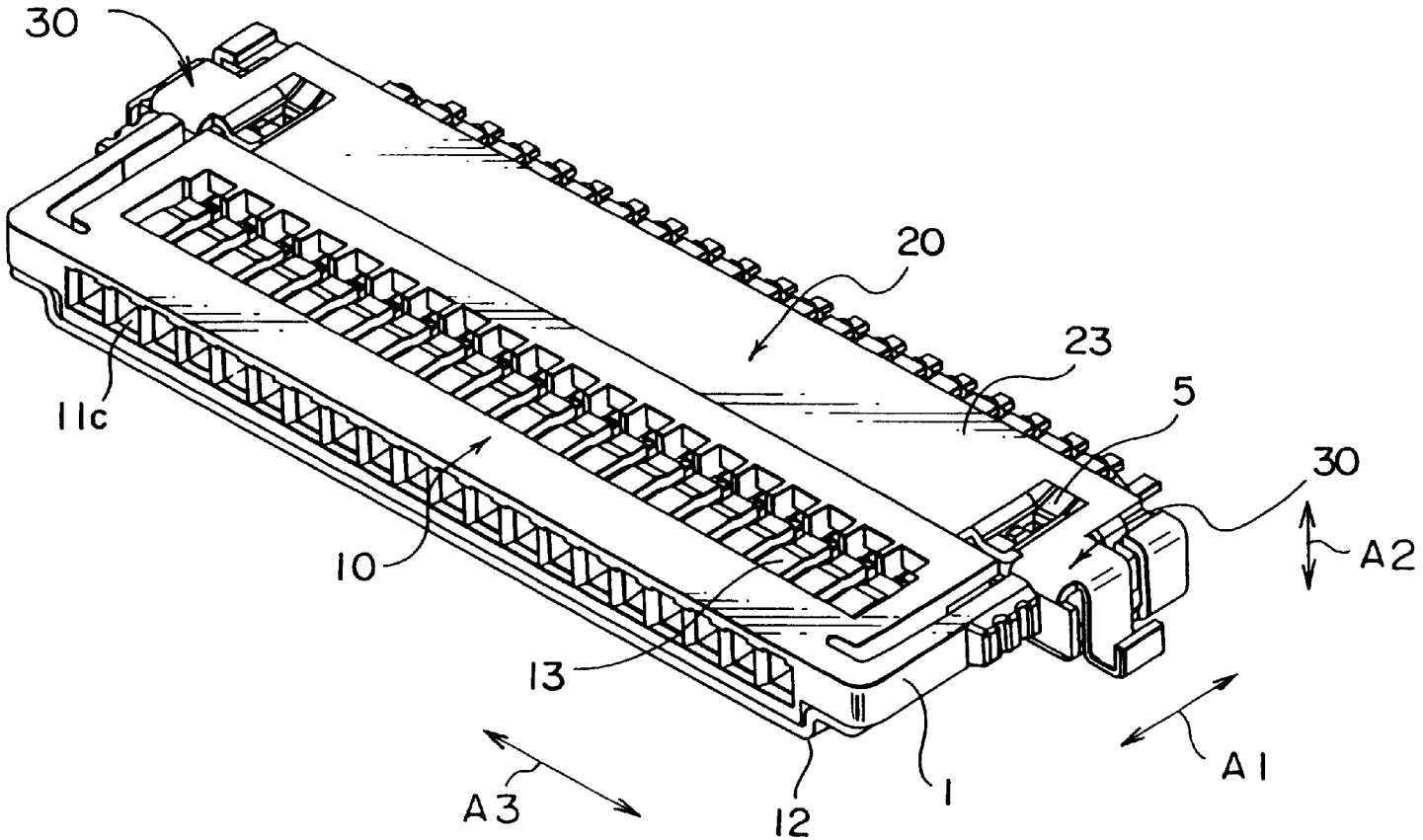
FIG. 1 is a perspective view of an electrical connector according to an embodiment of this invention.

Now, description will be made of an embodiment of this invention with reference to the drawing.

Figure 2:
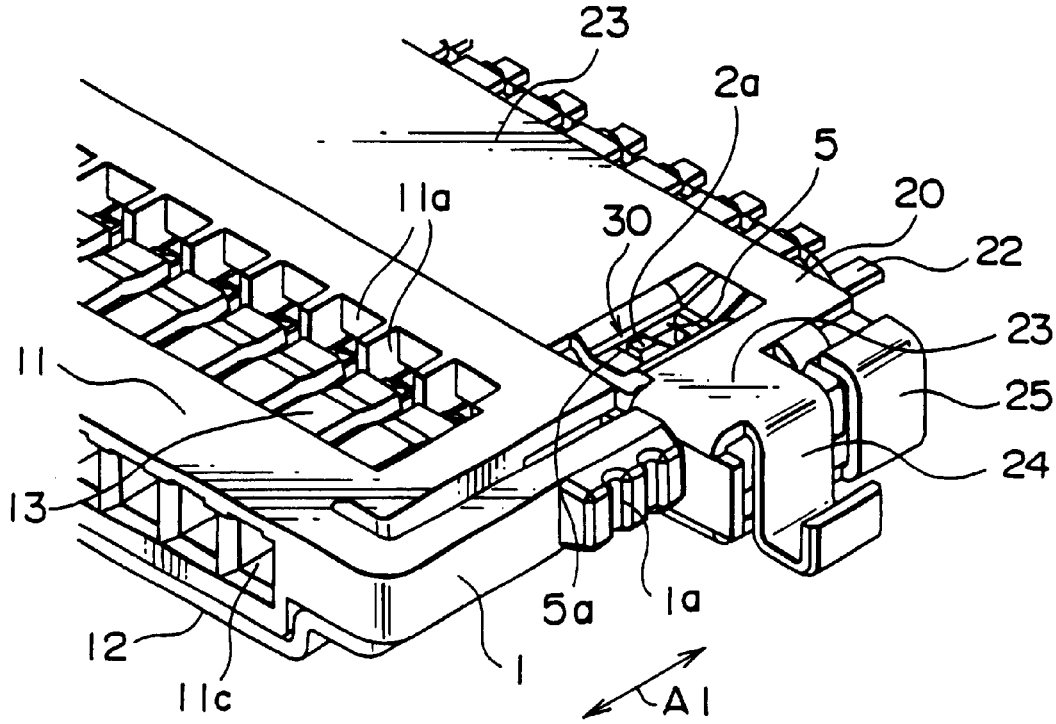
FIG. 2 is an enlarged perspective view showing a part of the electrical connector illustrated in FIG. 1.
Figure 3:
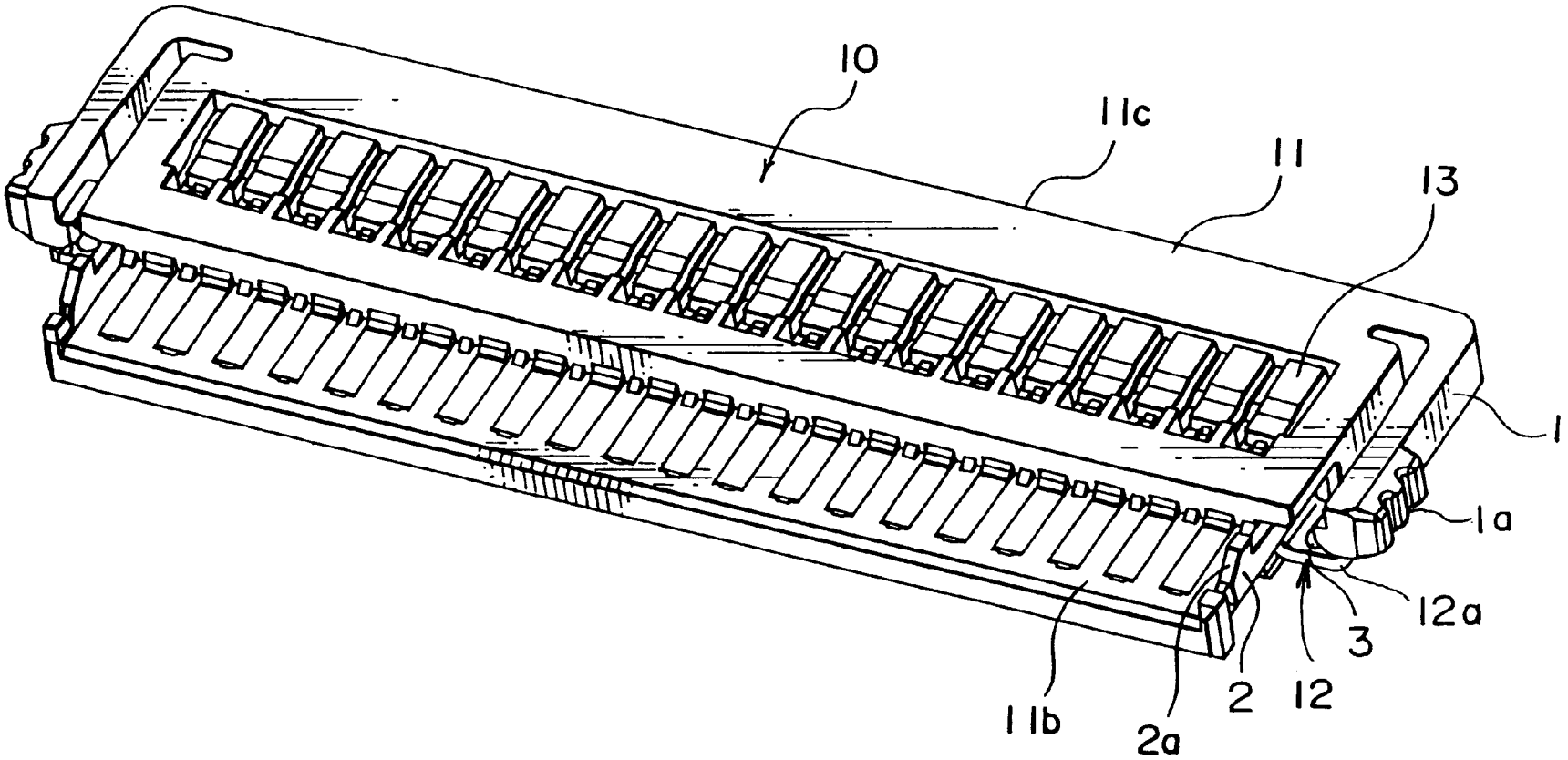
FIG. 3 is a perspective view of a plug connector contained in the electrical connector illustrated in FIG. 1.
Figure 4:
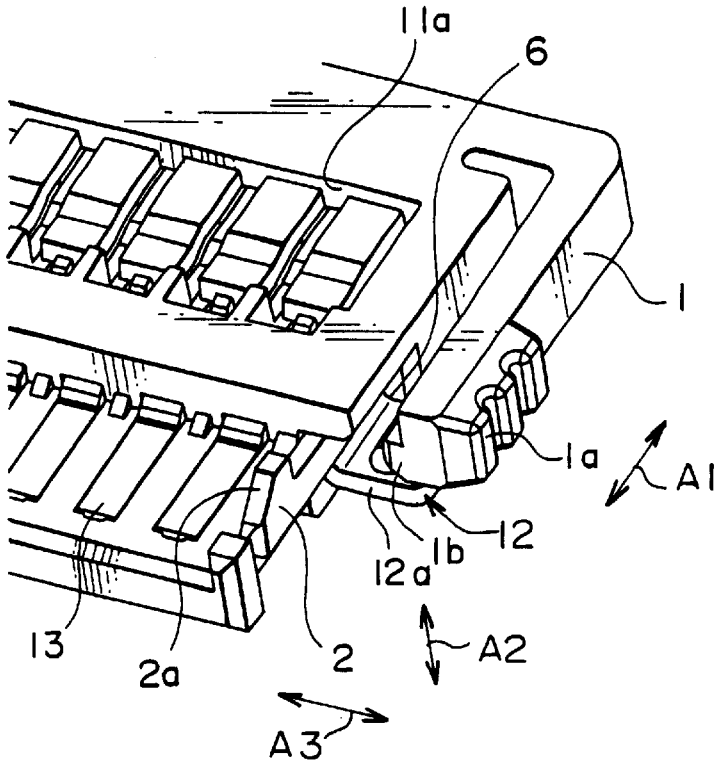
FIG. 4 is an enlarged perspective view showing a part of the plug connector illustrated in FIG. 3.
Figure 5:
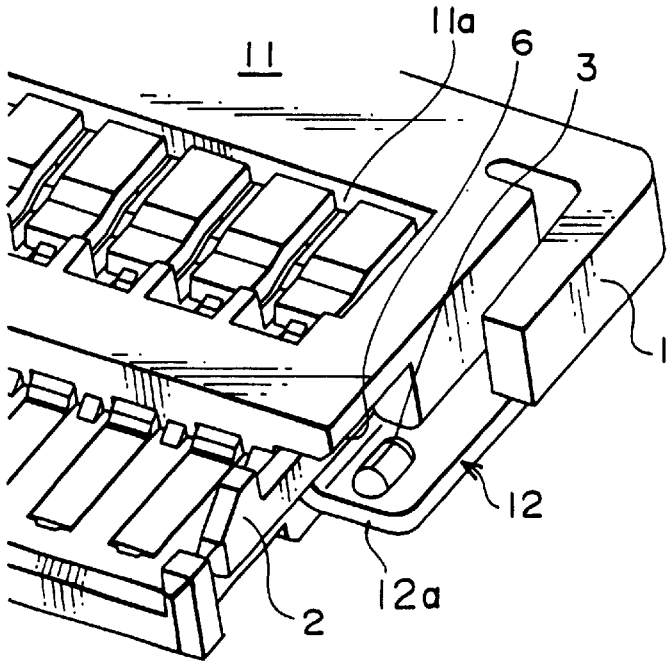
FIG. 5 is a view similar to FIG. 4 but partially cut away.

Referring to FIGS. 1 and 2, an electrical connector comprises a first or plug connector 10, a second or receptacle connector 20 fitted to each other in a first direction A1, and a pair of locking mechanisms 30 each consisted by a combination of portions of the plug and the receptacle connectors 10 and 20 in the manner which will later become clear.

Referring to FIGS. 3 through 6 in addition, the plug connector 10 comprises a box-like insulator 11 having a small size in a thickness direction as a second direction A2. The insulator 11 has a plurality of contact receiving portions 11*a*, a fitting portion 11*b* to be fitted to the receptacle connector 20, and a plurality of insertion holes 11*c* to receive pin terminals or the like. The insulator 11 has a lower surface covered with a metal shell 12. A plurality of plug contacts 13 are disposed in the contact receiving portions 11*a* within the insulator 11, respectively, and arranged in parallel to one another in a widthwise direction as a third direction A3.

The insulator 11 is provided on each of both sides in the third direction A3 with an unlocking arm 1 of a rectangular cylindrical shape and a locking member 2 of a hook-like shape. In the following, description will be mainly directed to only one side of the insulator 11 alone because the other side has a similar structure. The unlocking arm 1 extends laterally from the insulator 11 and then perpendicularly bent to extend forward. The unlocking arm 1 is displaceable in the third direction A3. The locking member 2 is integrally formed with the metal shell 12 and extends in the first direction A1. The locking member 2 is displaceable in the second direction A2. The locking member 2 has an engaging portion 2*a* to be engaged with the receptacle connector 20 in the first direction A1. The engaging portion 2*a* protrudes upward in the second direction A2.

Figure 6:
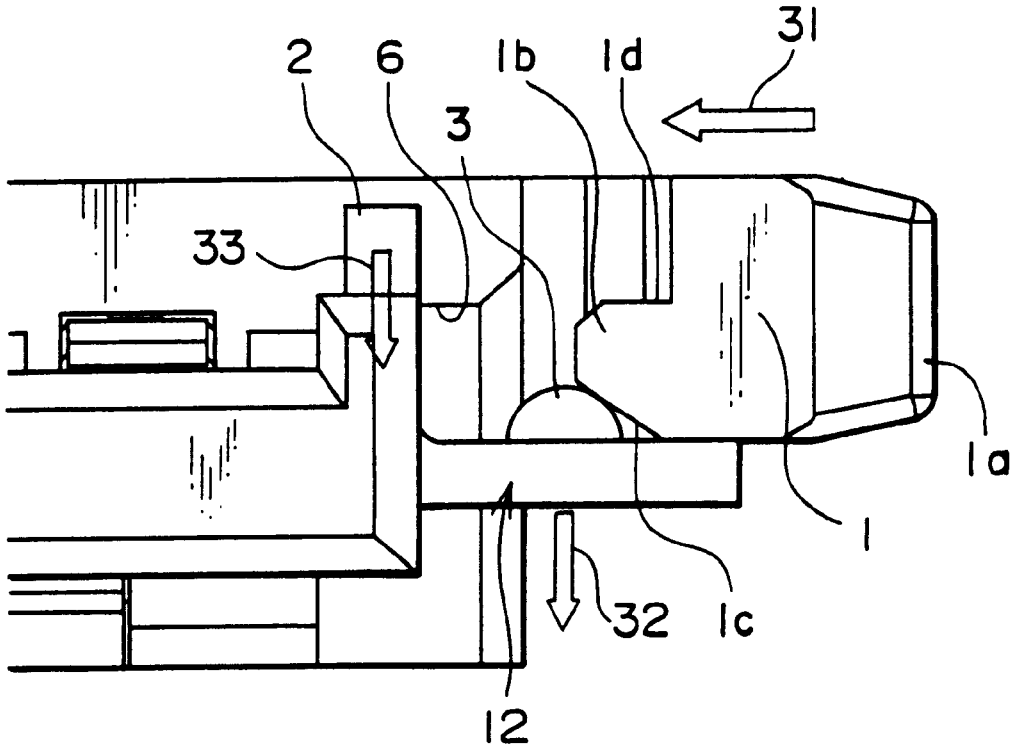
FIG. 6 is a front view of a part of the plug connector illustrated in FIG. 3.

The metal shell 12 has a lever 12*a* extending outward from the locking member 2 in the third direction A3 to serve as a lever. A combination of the lever 12*a* and the locking member 2 has a generally L-shaped cross section as best shown in FIG. 6.

The unlocking arm 1 is provided with an indented portion 1*a* formed on an outer surface of its end portion to be operated by a finger of an operator. The unlocking arm 1 is provided with a cam portion 1*b* formed on an inner surface of the end portion. The metal shell 12 has a protruding portion 3 formed on one surface thereof in the vicinity of its side edge to face the cam portion 1*b* of the unlocking arm 1 in the third direction A3. The protruding portion 3 has a semicircular shape in horizontal section and a generally semi-elliptical shape in vertical section.

In case where the unlocking arm 1 is displaced inward in the third direction A3, the cam portion 1*b* presses the protruding portion 3 in the second direction A2. When the protruding portion 3 is pressed by the cam portion 1*b*, the locking member 2 is displaced in the second direction A2 through the lever 12*a* of the metal shell 12. As a consequence, engagement between the engaging portion 2*a* and the receptacle connector 20 is released. Thus, the unlocking arm 1 and the locking member 2 cooperate through the protruding portion 3.

The plug contacts 13, the locking member 2, and the unlocking arm 1 are arranged on a substantially common plane in parallel to one another in the third direction A3. It is noted that the locking member 2 is arranged between an outermost one of the plug contacts 13 and the unlocking arm 1 in the third direction A3.

Figure 7:
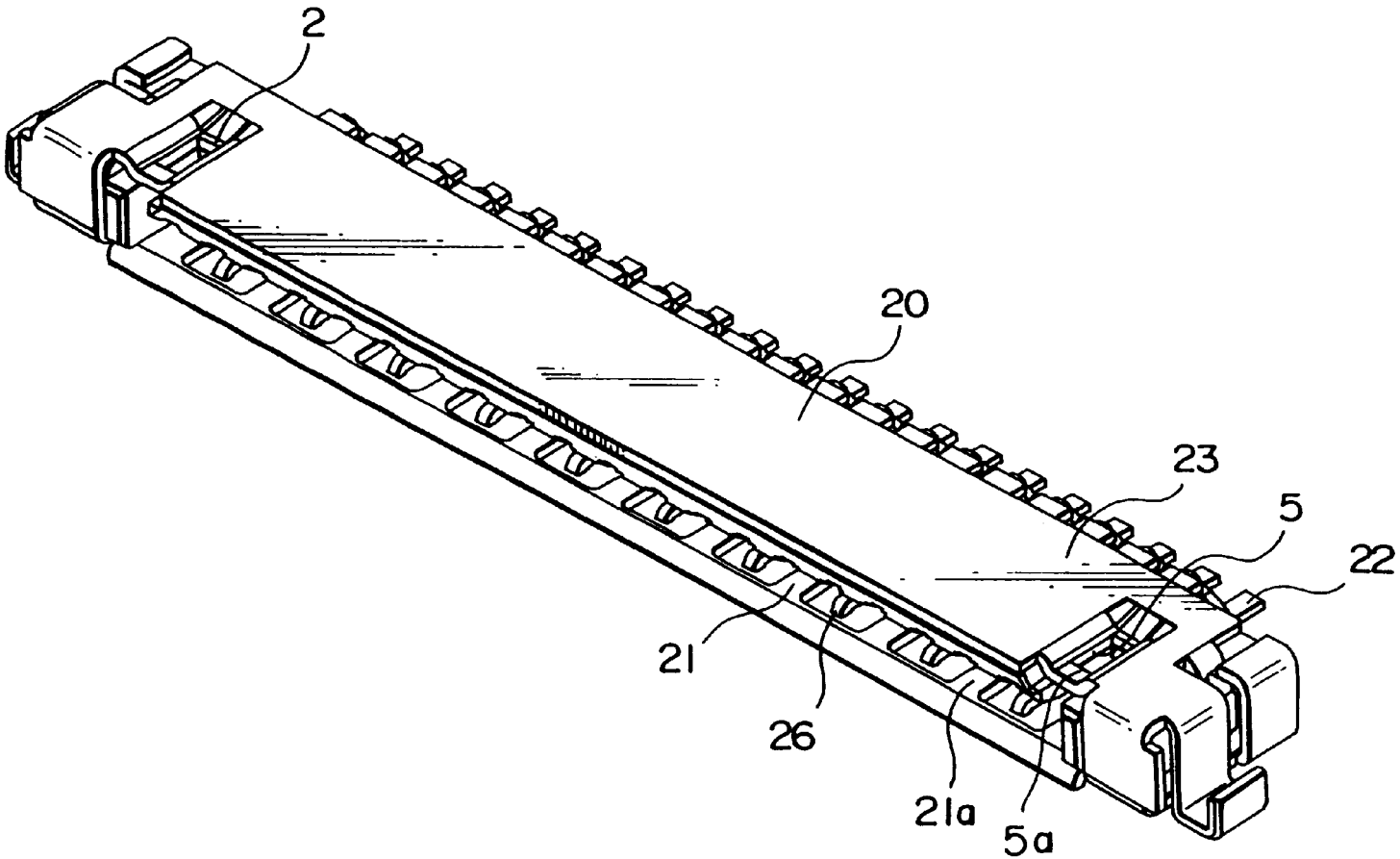
FIG. 7 is a perspective view of a receptacle connector contained in the electrical connector illustrated in FIG. 1.
Figure 8:
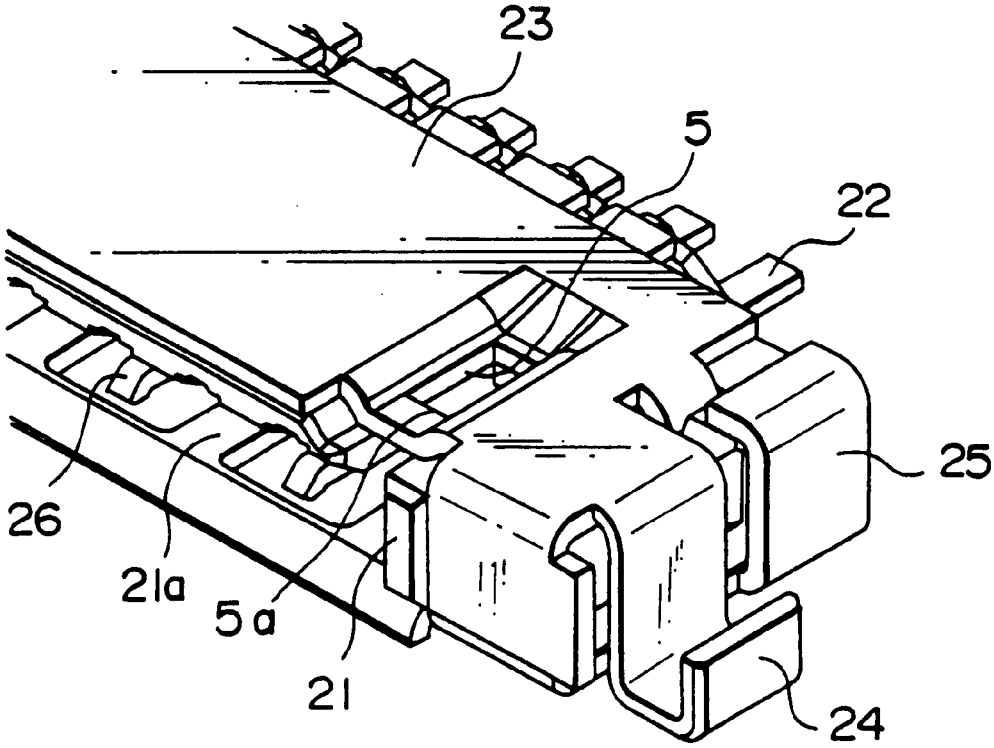
FIG. 8 is an enlarged perspective view of the receptacle connector illustrated in FIG. 7.

Referring to FIGS. 7 and 8 in addition, the receptacle connector 20 comprises a box-like insulator 21 having an opening portion or contact receiving portion 21*a*, a plurality of receptacle contacts 22 disposed in the contact receiving portion 21*a* of the insulator 21 and arranged in parallel to one another in a widthwise direction at predetermined pitch intervals, and a metal shell 23 defining upper and both side surfaces of the receptacle connector 20.

A plurality of ground contacts 26 are integrally formed with the metal shell 23 and placed on a bottom side of the contact receiving portion 21*a* and at the side to be fitted to the plug connector 10. The receptacle contacts 22 for signal transmission are disposed on an upper side of the opening portion 21*a* to be coupled with the plug contacts 13 when the plug connector 10 and the receptacle connector 20 are fitted to each other.

The receptacle connector 20 is provided with a pair of rectangular locking windows 5 formed on an upper surface thereof in the vicinity of its both sides. Each of the locking windows 5 is formed by drawing a part of the metal shell 23 inward. The locking window 5 is adapted to be engaged with the engaging portion 2*a* of the locking member 2 of the plug connector 10 when the receptacle connector 20 is fitted to the plug connector 10. Specifically, an edge of the locking window 5 forms a locking portion 5*a* to be engaged with the engaging portion 2*a*. In order to fix or support the receptacle connector 20 on a mounting surface of a circuit board (not shown), supporting portions 24 and 25 are formed integral with the metal shell 23.

Next referring to FIGS. 1 through 8 again, description will be made of an operation of the above-mentioned electrical connector.

When the plug connector 10 and the receptacle connector 20 are fitted to each other, the fitting portion 11*a* of the plug connector 10 is fitted into the contact receiving portion 21*a* of the receptacle connector 20. At this time, the locking member 2 is guided by the receptacle-side metal shell 23 to be deformed inward in a constrained position. Thereafter, at the position of the locking window 5 of the receptacle connector 20, the locking member 2 is released from the constrained position and the engaging portion 2*a* of the locking member 2 is engaged with the edge of the locking window 5 in the first direction A1 as illustrated in FIGS. 1 and 2. In other words, each of the locking mechanisms 30 is put in a locked state to lock the plug connector 10 and the receptacle connector 20 to each other in the first direction A1.

In this state, the plug contacts 13 and the receptacle contacts 22 are brought into contact with each other in one-to-one correspondence. Simultaneously, the ground contacts 26 formed integral with the receptacle-side metal shell 23 are brought into contact with the plug-side metal shell 12.

As described above, the locking window 5 formed on the receptacle-side metal shell 23 is formed by drawing a part of the metal shell 23 inward. Therefore, although the engaging portion 2*a* of the locking member 2 protrudes over a height corresponding to the drawing depth of the locking window 5 of the receptacle-side metal shell 23, no influence is given to the thickness of the electrical connector as a whole. Thus, a sufficient depth of locking engagement is assured. Upon fitting, it is unnecessary to operate the unlocking arm 1 of the plug connector 10.

As illustrated in FIG. 6, the unlocking arm 1 is pushed in a direction depicted by an arrow 31. Then, the unlocking arm 1 is displaced inward so that a slant surface 1*c* formed inside at a lower end of the cam portion 1*b* of the unlocking arm 1 climbs up over the protruding portion 3. Then, the protruding portion 3 moves downward as depicted by an arrow 32 to deform the metal shell 12. Furthermore, an upper surface 1*d* of the cam portion 1*b* of the unlocking arm 1 is just received on a ceiling surface 6 formed in the plug-side insulator 11. Thus, the cam portion 1*b* of the unlocking arm 1 is positioned in the second direction A2.

As a consequence, the plug-side metal shell 12 is deformed in the direction depicted by the arrow 32 over a distance corresponding to the height of the protruding portion 3 of the metal shell 12. Accordingly, the engaging portion 2*a* of the locking member 2 is displaced in the direction depicted by the arrow 32 to be disengaged from the locking portion 5*a* of the locking window 5 of the receptacle connector 20. Thus, locking is released so that the plug connector 10 can be disconnected from the receptacle connector 20. Since the protruding portion 3 is formed backward from the engaging portion 2*a*, the engaging portion 2*a* is displaced in the direction depicted by the arrow 32 over a distance greater than the height of the protruding portion 3. Thus, a greater displacement of the engaging portion 2*a* can be assured. It is therefore possible to realize a stable and reliable unlocking operation.

In the above-mentioned electrical connector, the locking member 2 is moved within the locking mechanism 30 in the connector thickness direction. Therefore, the profile of the fitting portion 11*a* can be reduced in size in a contact pitch direction, i.e., the third direction A3. In the locking mechanism 30, the unlocking movement of the locking member 2 is maintained in a constant level even if the operating amount of the unlocking arm 1 is increased after the operating amount exceeds a predetermined level. Therefore, the unlocking operation is stably and reliably carried out without requiring excessive force. In the plug connector 10, when the unlocking arm 1 climbs up over the protruding portion 3, the unlocking arm 1 is subjected to reactive force and forced to deform in an opposite direction against the unlocking operation. However, such deformation of the unlocking arm 1 is suppressed by the ceiling surface 6 to thereby stabilize the unlocking movement. Since the protruding portion 3 is formed at a position nearer to a base of the locking member 2 than to the engaging portion 2*a* at its end, it is possible to gain a greater movement of the engaging portion 2*a* of the locking member 2 than the height of the protruding portion 3. This makes it possible to perform a reliable unlocking operation.

Thus, the above-mentioned electrical connector is adapted to connect a thin-type liquid crystal display used in a thin-type electronic apparatus such as a notebook-type personal computer.

What is claimed is:

1. An electrical connector including a first and a second connector fitted to each other in a first direction, said first connector comprising:

a locking member extending in said first direction and displaceable in a second direction perpendicular to said first direction;

a lever extending from said locking member in a third direction perpendicular to said first and said second directions;

a protruding portion protruding from said lever in said section direction;

an unlocking arm extending in said first direction and displaceable in said third direction said locking member having angaging portion to be engaged with said second connector in said first direction, said unlocking arm having a cam portion for pressing said protruding portion in said second direction when said unlocking arm is displaced in said third direction, said second connector having a locking portion to be engaged with said engaging portion in said first direction when said first and said second connectors are fitted to each other, engagement between said engaging portion and said locking portion being released when said protruding portion is pressed by said cam portion to displace said locking member in said second direction through said lever;

wherein said second connector has a metal shell, said locking portion being formed on said metal shell;

wherein said metal shell has a locking window, said locking window having an edge serving as said locking portion; and wherein said locking window is formed by drawing a part of said metal shell inward.

2. The electrical connector according to claim 5, wherein a combination of said locking member and said lever has a generally L-shaped cross section.

3. An electrical connector including a first and a second connector fitted to each other in a first direction, said first connector comprising:

a locking member extending in said first direction and displaceable in a second direction perpendicular to said first direction;

a lever extending from said locking member in a third direction perpendicular to said first and said second directions;

a protruding portion protruding from said lever in said second direction;

an unlocking arm extending in said first direction and displaceable in said third direction, said locking member having an engaging portion to be engaged with said second connector in said first direction, said unlocking arm having a cam portion for pressing said protruding portion in said second direction when said unlocking arm is displaced in said third direction, said second connector having a locking portion to be engaged with said engaging portion in said first direction when said first and said second connectors are fitted to each other, engagement between said engaging portion and said locking portion begin released when said protruding portions pressed by said cam portion to displace said locking member in said second direction through said lever; and wherein said first connector comprises a plurality of contacts, said contacts, said locking member, and said unlocking arm being arranged on a substantially common plane to be parallel to one another in said third direction.

4. The electrical connector according to claim 3, wherein a combination of said locking member and said lever has a generally L-shaped cross section.

5. The electrical connector according to claim 3, wherein said locking member is arranged between an outermost one of said contacts and said unlocking arm in said third direction.

6. A plug connector comprising:

a locking member extending in a first direction and displaceable in a second direction perpendicular to said first direction;

a lever extending from said locking member in a third direction perpendicular to said first and said second directions;

a protruding portion protruding from said lever in said second direction;

an unlocking arm extending in said first direction and displaceable in said third direction, said locking member having an engaging portion to be engaged with a receptacle connector in said first direction, said unlocking arm having a cam portion for pressing said protruding portion in said second direction when said unlocking arm is displaced in said third direction, engagement between said engaging portion and said receptacle connector being released when said protruding portion is pressed by said cam portion to displace said locking member in said second direction through said lever; and a plurality of contacts, wherein said contacts, said locking member, and said unlocking arm are arranged on a substantially common plane to be parallel to one another in said third direction.

7. The plug connector according to claim 6, wherein a combination of said locking member and said lever has a generally L-shaped cross section.

8. The plug connector according to claim 6, wherein said locking member is arranged between an outermost one of said contacts and said unlocking arm in said third direction.

9. A receptacle connector to be fitted in a first direction to a plug connector, which comprises:

a locking member extending in said first direction and displaceable in a second direction perpendicular to said first direction;

a lever extending from said locking member in a third direction perpendicular to said first and said second directions;

a protruding portion protruding from said lever in said second direction;

an unlocking arm extending in said first direction and displaceable in said third direction said locking member having an engaging portion to be engaged with a receptacle connector in said first direction said unlocking arm having a cam portion for pressing said protruding portion in said second direction when said unlocking arm is displaced in said third direction engagement between said engaging portion and said receptacle connector being released when said protruding portion is pressed by said cam portion to displace said locking member in said second direction through said lever;

said receptacle connector comprising a metal shell and a locking portion formed on said metal shell to be engaged with said engaging portion in said first direction when said receptacle connector is fitted to said plug connector, wherein said metal shell has a locking window having an edge serving as said locking portion, and wherein said locking window is formed by drawing a part of said metal shell inward.

* * * * *